US010393422B2

(12) United States Patent
Park et al.

(10) Patent No.: US 10,393,422 B2
(45) Date of Patent: Aug. 27, 2019

(54) AIR CONDITIONER

(71) Applicant: Samsung Electronics Co., Ltd., Suwon-si (KR)

(72) Inventors: Hyun Uk Park, Suwon-si (KR); Geon Hee Lee, Yangsan-si (KR); Ji Won Yoon, Sokcho-si (KR); Jea Won Lee, Hwaseong-si (KR); Seung Il Han, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 852 days.

(21) Appl. No.: 14/467,551

(22) Filed: Aug. 25, 2014

(65) Prior Publication Data

US 2015/0075201 A1 Mar. 19, 2015

(30) Foreign Application Priority Data

Sep. 17, 2013 (KR) ..... 10-2013-0111528

(51) Int. Cl.
*F25D 17/04* (2006.01)
*F25D 23/00* (2006.01)
(Continued)

(52) U.S. Cl.
CPC ..... *F25D 17/04* (2013.01); *F24F 1/0011* (2013.01); *F24F 1/0057* (2019.02); *F24F 13/12* (2013.01);
(Continued)

(58) Field of Classification Search
CPC ..... F25D 17/04; F25D 23/006; F24F 13/12; F24F 1/0011
(Continued)

(56) References Cited

U.S. PATENT DOCUMENTS 5,782,688 A * 7/1998 Baek ..... F24F 1/0011 454/233
6,513,859 B2 * 2/2003 Yuge ..... E05F 15/619 296/146.4
(Continued)

FOREIGN PATENT DOCUMENTS

CN 1086462 6/2002
CN 1888591 1/2007
(Continued)

OTHER PUBLICATIONS

Extended European Search Report dated Feb. 3, 2015 in European Patent Application No. 1418430.9.
(Continued)

*Primary Examiner* — Kenneth Rinehart
*Assistant Examiner* — Phillip Decker
(74) *Attorney, Agent, or Firm* — Staas & Halsey LLP

(57) ABSTRACT

An air conditioner including a door installed in order to provide a smooth appearance by hiding an outlet is provided. The air conditioner is installed on a wall and includes a front panel including a first panel part provided with an inlet and a second panel part connected to a lower portion of the first panel part and provided with an outlet; a lower panel connected to the second panel part of the front panel and extended toward the wall; and a door installed on a front surface of the second panel part so as to open and close the outlet while being slid, wherein the door is slid along a curved movement trajectory toward the lower panel, and a curvature of the movement trajectory is changed. A clean and smooth appearance may be formed using a door slid along a curved path and a slim appearance may be formed even in the state in which the door is opened.

29 Claims, 9 Drawing Sheets

(51) Int. Cl.

| | |
|---|---|
| ***F24F 13/12*** | (2006.01) |
| ***F24F 1/0011*** | (2019.01) |
| ***F24F 1/0057*** | (2019.01) |
| *F24F 13/14* | (2006.01) |

(52) U.S. Cl.
CPC .... *F25D 23/006* (2013.01); *F24F 2013/1433* (2013.01); *F24F 2013/1446* (2013.01)

(58) Field of Classification Search
USPC ..... 454/241
See application file for complete search history.

(56) References Cited

U.S. PATENT DOCUMENTS

| | | | | |
|---|---|---|---|---|
| 6,609,563 | B1 * | 8/2003 | Tsurushima | B60H 1/00692 165/202 |
| 7,587,908 | B2 * | 9/2009 | Kim | F24F 13/20 62/262 |
| 7,670,414 | B2 * | 3/2010 | Cha | B01D 46/12 55/418 |
| 7,794,314 | B2 * | 9/2010 | Sekiya | B60H 1/00692 165/41 |
| 7,849,706 | B2 * | 12/2010 | Yasutomi | F24F 1/0007 62/186 |
| 7,987,680 | B2 * | 8/2011 | Hamada | F24F 1/0007 165/222 |
| 8,074,462 | B2 * | 12/2011 | Yasutomi | F24F 1/0007 62/262 |
| 8,777,705 | B2 * | 7/2014 | Nomura | B60H 1/00692 454/160 |
| 9,255,722 | B2 * | 2/2016 | Kim | F24F 13/20 |
| 9,829,211 | B2 * | 11/2017 | Zhang | F24F 13/08 |
| 2004/0111970 | A1 * | 6/2004 | Fenelon | E05F 11/385 49/349 |
| 2010/0024308 | A1 * | 2/2010 | Coubray | E05F 15/67 49/362 |
| 2011/0059685 | A1 * | 3/2011 | Ido | B60H 1/00692 454/69 |
| 2011/0197512 | A1 * | 8/2011 | Nomura | B60H 1/00692 49/70 |
| 2011/0277495 | A1 * | 11/2011 | Lee | F24F 1/0007 62/428 |
| 2013/0149953 | A1 * | 6/2013 | Seto | B60H 1/00692 454/155 |
| 2015/0011155 | A1 * | 1/2015 | Zhang | F24F 13/1426 454/284 |
| 2017/0176026 | A1 * | 6/2017 | Lee | F24F 13/12 |
| 2018/0328599 | A1 * | 11/2018 | Lin | F24F 1/0011 |

FOREIGN PATENT DOCUMENTS

| | | | | |
|---|---|---|---|---|
| CN | 101377332 | | 3/2009 | |
| CN | 101737864 | | 6/2010 | |
| CN | 102472521 | | 5/2012 | |
| CN | 202470348 | | 10/2012 | |
| EP | 2031320 | A1 | 3/2009 | |
| EP | 2455679 | A1 | 5/2012 | |
| KR | 20040028134 | A * | 4/2004 | |
| KR | 100776595 | B1 * | 11/2007 | F24F 1/0011 |
| WO | 2010/143378 | A1 | 12/2010 | |
| WO | 2013/127290 | A1 | 9/2013 | |

OTHER PUBLICATIONS

European Office Communication dated Jul. 20, 2017 in European Patent Application No. 14184830.9.
Chinese Office Action dated Apr. 2, 2018 in Chinese Patent Application No. 201410475196.X.
European Office Action dated Jul. 27, 2018 issued in European Patent Application No. 14 184 830.9-1008.
Chinese Office Action dated Oct. 8, 2018 in Chinese Patent Application No. 201410475196.X.
Chinese Notice of Allowance dated Apr. 19, 2019 in Chinese Patent Application No. 201410475196.X.

* cited by examiner

AIR CONDITIONER

CROSS-REFERENCE TO RELATED APPLICATIONS

This application claims the priority benefit of Korean Patent Application No. 10-2013-111528, filed on Sep. 17, 2013, which is hereby incorporated by reference in its entirety into this application.

BACKGROUND

1. Field

Embodiments relate to an air conditioner, and more particularly, to an air conditioner including a door installed in order to provide a smooth appearance by hiding an outlet.

2. Description of the Related Art

In general, an air conditioner is a device removing dust, and the like, present in the air while conditioning distribution of a temperature, humidity, an air current, and the like, appropriate for human activities using a cooling cycle. Main components configuring the cooling cycle include a compressor, a condenser, an evaporator, an expansion valve, a blowing fan, and the like.

The air conditioner may be divided into a separation type air conditioner in which an indoor unit and an outdoor unit are separately installed and an integration type air conditioner in which an indoor unit and an outdoor unit are installed together in a single cabinet. Among those, the indoor unit of the separation type air conditioner includes a heat exchanger heat-exchanging air sucked into a panel and a blowing fan sucking air of the interior into the panel and again blowing the sucked air to the interior.

A wall mounted air conditioner having a form in which it is fixedly installed on a wall among forms of the indoor units is formed so that an outlet is exposed on an appearance.

A wall mounted air conditioner, which is one type of air conditioners, installed in a way to be fixed to a wall is provided to have an outlet exposed on the appearance.

A blade installed at the outlet simultaneously serves to open and close the outlet and to control a wind direction in a vertical direction. Since a predetermined distance should be maintained between the blade and peripheral components in order to drive the blade, even in the case in which the air conditioner is not operated, an outer line of the outlet is exposed to the outside.

Recently, as a design element of the air conditioner has become important, there is a tendency to hide the outlet or install the outlet so as to be naturally in harmony with peripheral components. To this end, an air conditioner provided with a door opening and closing the outlet has been developed. Rack and pinion gears are mainly used in order to slide the door. However, in most cases, since the door is driven and opened by linear movement or curved movement close to the linear movement, an appearance of the air conditioner seems to be large.

SUMMARY

In an aspect of one or more embodiments, there is provided an air conditioner having a smooth appearance by completely hiding an outlet.

In an aspect of one or more embodiments, there is provided an air conditioner having an entirely slim appearance using a door slid while having a changing curvature.

In an aspect of one or more embodiments, there is provided an air conditioner installed on a wall, the air conditioner including: a front panel including a first panel part provided with an inlet and a second panel part connected to a lower portion of the first panel part and provided with an outlet; a lower panel connected to the second panel part of the front panel and extended toward the wall; and a door installed on a front surface of the second panel part so as to open and close the outlet while being slid, wherein the door is slid along a curved movement trajectory toward the lower panel, and a curvature of the movement trajectory is changed.

The air conditioner may further include a driving device positioned at one side of an inner portion of the second panel part and providing power so that the door is slidable.

The driving device may include a motor providing the power, a pinion having a shaft connected to the motor to thereby be rotated, and a rack engaged and moved with the pinion.

One side of the rack and one side of the door may be coupled to each other while having the second panel part disposed therebetween so that the door is movable as the rack moves toward the lower panel.

The rack may be extended in a length direction while having a curvature, and the door and the rack may have different curvatures.

The door may have a curvature larger than that of the rack so that it is slid adjacently to the lower panel.

The first and second panel parts may be formed as a curved surface so that the front panel protrudes so as to be convex with respect to the wall, and a portion at which the first and second panel parts are connected to each other may have a maximum spacing distance from the wall.

One side of the first panel part may contact the wall, and one side of the second panel part may be spaced apart from the wall so that the lower panel is positioned.

The air conditioner may further include a cover covering upper portions of the first and second panel parts, wherein the door is connected to the cover to cover a lower portion of the second panel part and the cover and the door have the same thickness so as to form a smooth surface.

The air conditioner may further include a pair of side panels installed on both sides of the front panel and the lower panel, wherein the door includes side ribs formed on both sides thereof, the side ribs protruding so as to contact the pair of side panels.

The pair of side panels may include side guides concavely formed on outer surfaces thereof along the movement trajectory, respectively, so that the door is stably movable, and the side ribs may include protrusions protruding toward the pair of side panels so as to be fitted into the side guides, respectively.

The motor may be a step motor rotated by a predetermined angle depending on input pulses.

The motor may be operated so as to be variably controlled in a relief section in which additional power is required while the door reciprocates.

The outlet may be provided with a blade for changing a direction of discharged air.

In an aspect of one or more embodiments, there is provided an air conditioner including: a front panel formed so as to be convex with respect to a wall and having an outlet disposed at a lower portion thereof; a door installed on a front surface of the front panel so as to open and close the outlet; and a driving device including a pinion rotatably installed in the front panel so that the door opens and closes the outlet while being slid and a rack engaged and moved with the pinion, wherein one side of the rack and one side of the door are connected to each other so that the lower portion of the front panel is positioned between the rack and the door.

The driving device may include a case fixed in the front panel so as to form an appearance to protect the pinion and the rack positioned therein.

The case may include an opening formed at one side thereof so that the rack is movable outwardly, and one side of the rack exposed through the opening may be connected to one side of the door.

An inner portion of the case may be provided with a guide concavely formed along a movement path of the rack so that the rack is stably movable.

The rack may include a sawtooth engaged with the pinion and rack ribs formed on both sides of the sawtooth, wherein the rack rib is inserted into the guide while having a gap in order to decrease contact friction with the guide.

The guide may be formed in a partial section of the movement path of the rack in order to decrease contact friction between the rack and the guide.

An inner surface of one side of the door may be provided with a protrusion, and one side of the rack may be coupled to the protrusion while being fitted into the protrusion so that the door is moved as the rack is moved.

The protrusion may include a rib extended toward an opening, and the rack and the rib may be coupled to each other in a length direction of the rack.

In an aspect of one or more embodiments, there is provided an air conditioner including: a body forming an appearance; an outlet formed at a lower portion of the body and discharging air; a door installed on a front surface of the body so as to open and close the outlet while being slid; a driving device providing power so that the door is slidable; and an auxiliary device installed so as to elastically bias the door upwardly.

The driving device may include a rotating pinion and a rack engaged and moved with the pinion, and the auxiliary device may include a spring providing elastic force and a connection member connected to one side of the spring to thereby be moved.

The driving device may include a case formed so that the auxiliary device is positioned therein, the case may include an opening formed at one side thereof so that the rack is movable outwardly, and one side of the rack exposed through the opening may be connected to one side of the door.

One side of the spring may be fixed to one side of the case, and a side of the connection member opposite to the side of the connection member connected to the spring may be coupled to the rack so that the connection member is movable as the rack is moved.

The connection member may include protrusions formed at both sides thereof, and both sides of the case may be provided with auxiliary guides formed as an opening along an interworking section in which the connection member and the rack are coupled to each other and are moved, so that the protrusions are fitted thereinto and moved therealong.

One side of the auxiliary guide may be provided with a bent fixing groove into which the protrusion is inserted, so that the connection member is separated from the rack and is fixed in the state in which the spring is expanded, in the case in which the rack is moved outwardly through the opening.

The auxiliary guide may include a safety groove having the protrusion inserted thereinto by the rack and then returning the protrusion to the fixing groove so that the rack enters the connection member through the opening to thereby be coupled to the connection member, in the case in which the protrusion deviates from the fixing groove due to external impact, such that the connection member is moved by the elastic force.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
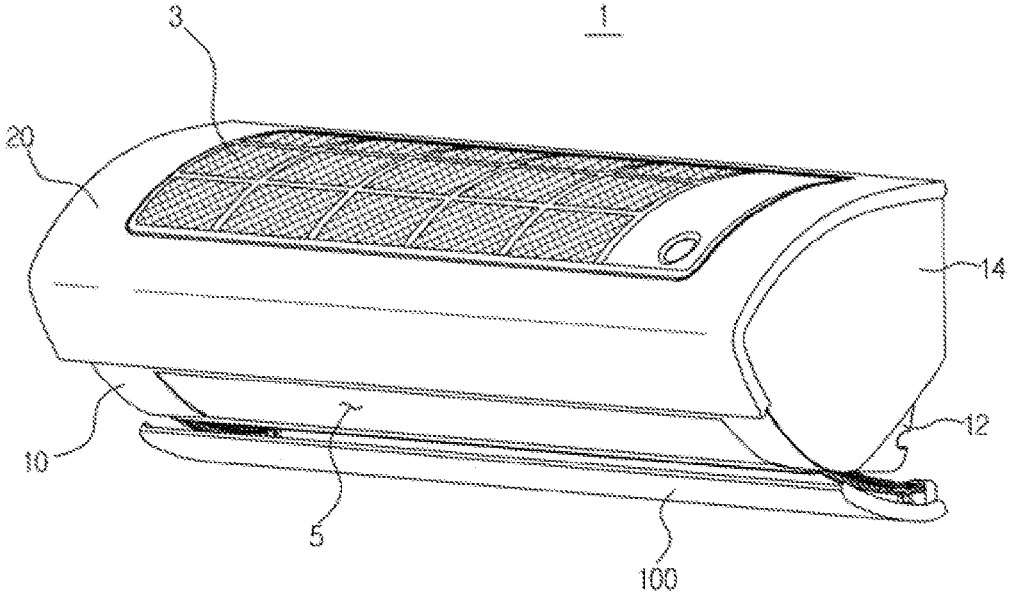
FIG. 1 is a diagram showing an air conditioner according to an exemplary embodiment.

Reference will now be made in detail to embodiments, examples of which are illustrated in the accompanying drawings, wherein like reference numerals refer to the like elements throughout. Hereinafter, exemplary embodiments will be described in detail with reference to the accompanying drawings.

FIG. 1 is a diagram showing an air conditioner 1 according to an exemplary embodiment.

The air conditioner 1 heat-exchanges high temperature air with a low temperature refrigerant using a cooling cycle including a compressor, a condenser, an expansion valve, and an evaporator and then supplies low temperature air to the interior. Generally, the compressor and the condenser are disposed in an outdoor unit of the air conditioner, the expansion valve is disposed in any one of the indoor unit and the outdoor unit, and the evaporation is disposed in the indoor unit.

The indoor unit is divided into a stand type indoor unit standing on a floor in order to cool or heat a relatively large indoor space and a wall mounted type indoor unit mounted on a wall in order to cool or heat a relatively small indoor space.

The wall mounted type air conditioner 1 mounted on the wall includes a body provided with an inlet 3 and an outlet 5. The body includes a rear panel fixed to the wall and a front panel 10, a lower panel 12, and a pair of side panels 14 that enclose internal components such as a heat exchanger.

The inlet may be disposed at an upper portion of the front panel 10. The inlet 3 may be always opened or be opened by an operation of the air conditioner 1. The inlet 3 may be provided with a filter device for removing foreign materials of air introduced from the interior into the air conditioner 1.

The outlet 5 may be positioned at a lower portion of the front panel 10. The outlet 5 is a path through which the air introduced through the inlet 3 passes through the heat exchanger and is then discharged to the outside of the air conditioner 1. A blade 7 (See FIG. 2) may be installed on a front surface of the outlet 5 to control a direction in which the air is discharged.

As described above, the air conditioner 1 according to an exemplary embodiment has a structure in which both of the inlet 3 and the outlet 5 are installed in the front panel 10. An upper panel corresponding to the lower panel 12 is not present, and the front panel 10 has one side contacting the wall to protrude so as to be convex with respect to the wall. The front panel 10 may include a first panel part provided with the inlet 3 and a second panel part connected to a lower portion of the first panel part and provided with the outlet 5.

The first and second panel parts of the front panel 10 may be formed as a curved surface, and a portion at which the first and second panel parts are connected to each other may have a maximum spacing distance from the wall. One side of the first panel part may contact the wall and the other side thereof may be connected to the second panel part. One side of the second panel part may be connected to the first panel part and the other side thereof may be connected to the lower panel 12. The second panel part may be spaced apart from the wall so that the lower panel 12 may be positioned between the second panel part and the wall.

The pair of side panels 14 may be installed on both sides of the front panel 10 and the lower panel 12, respectively, to form the body of the air conditioner 1. The front panel 10 and the pair of side panels 14 may be formed integrally with each other. The first and second panel parts may have a cover 20 attached to front surfaces of upper portions thereof. The cover 20 may be manufactured by double injection and form an appearance of the air conditioner 1.

The front surface of the second panel part may be provided with a door 100 for opening and closing the outlet 5. The door 100 may be connected to a lower portion of the cover 20 to cover the outlet 5 of the second panel part. The cover 20 and the door 100 may have the same thickness so that the air conditioner 1 may have a smooth surface. The door 100 may be manufactured by double injection, be attached to the front panel 10, and form the appearance of the air conditioner 1.

In the case in which the air conditioner 1 is not operated, the door 100 covers the outlet 5 and is connected to the cover 20, thereby making it possible to form a front surface of the air conditioner 1. The door 100 completely covers the outlet 5, such that the outlet 5 may not be exposed to the outside. Therefore, the air conditioner 1 may be formed on the wall so that the front surface thereof formed by the cover 20 and the door 100 is exposed to the outside.

In the case in which the air conditioner 1 is operated, the door 100 may be slid toward the lower panel 12 to expose the outlet 5 to the outside. The door 100 may be slid along a curved movement trajectory to expose the outlet 5. In the case in which the door 100 is completely opened, a curvature of the movement trajectory may be changed so that the appearance of the air conditioner 1 seems to be slim.

Figure 2:
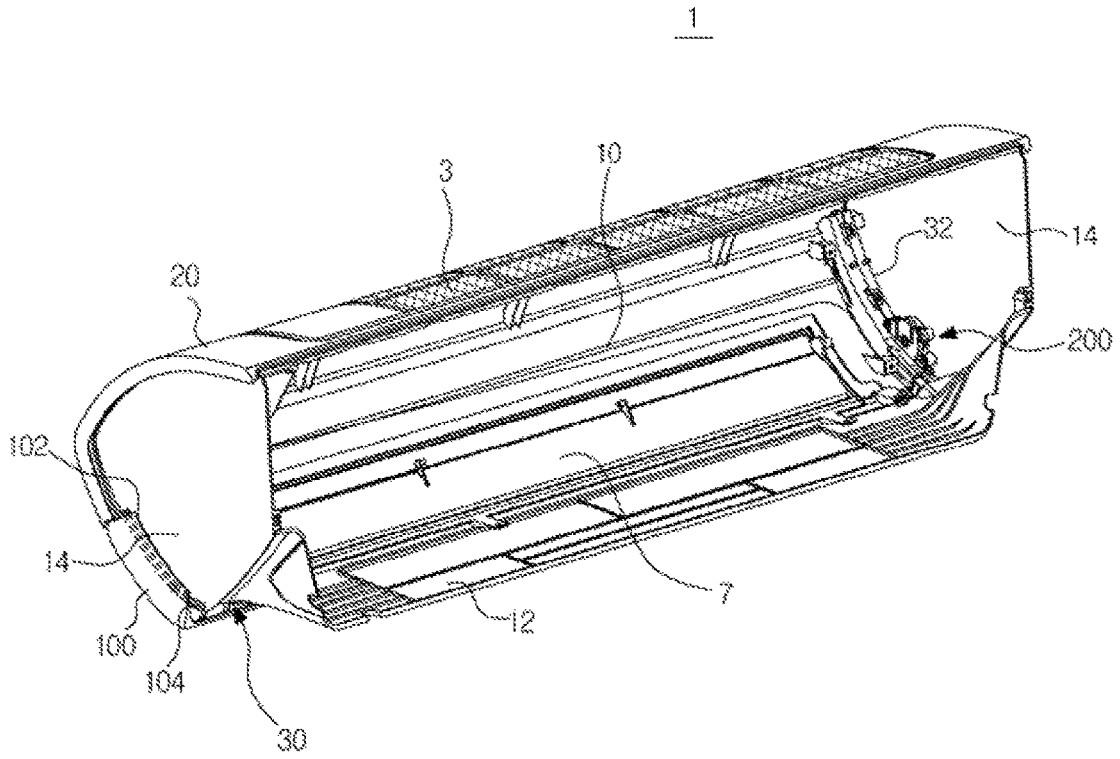
FIGS. 2 and 3 are diagrams showing a rear surface of the air conditioner according to an exemplary embodiment.
Figure 3:
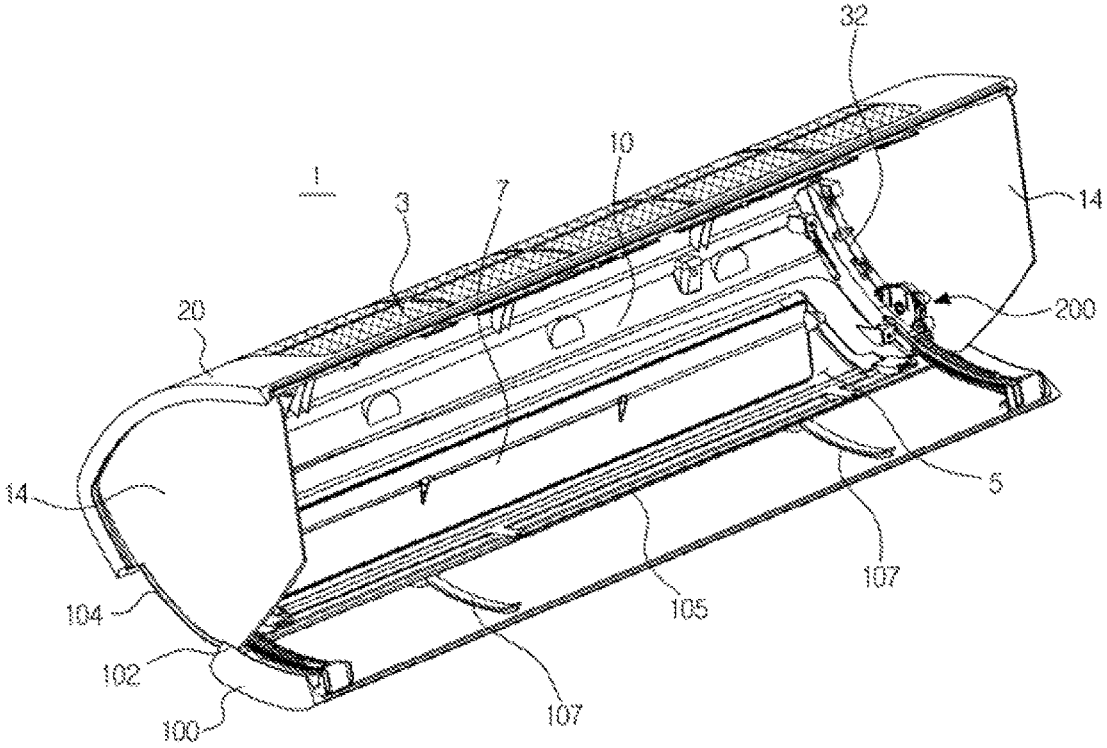

FIGS. 2 and 3 are diagrams showing a rear surface of the air conditioner 1 according to an exemplary embodiment, wherein FIG. 2 shows the case in which the door 100 is closed and FIG. 3 shows the case in which the door 100 is opened. In FIG. 3, the lower panel 12 is not shown in order to show a rear surface of the door 100.

In the body of the air conditioner 1, the front panel 10 including the outlet 5 and the side panel 14 may be formed integrally with each other. The lower panel 12 may be connected to the side panel 14 and the front panel 10, and the cover 20 and the door 100 may be attached to a front surface of the front panel 10. The blade 7 capable of changing a direction in which the air is discharged may be installed on the outlet formed in the front panel 10, and an installation member for installing the blade 7 may be attached to the front surface of the front panel 10.

An inner portion of the front panel 10 may be provided with driving devices 200 providing power so that the door 100 may be slid. The driving devices 200 may be disposed at both sides of an inner surface of the front panel 10 so as to be adjacent to two side panels 14.

Edges at which all of the side panels 14, the front panel 10, and the lower panel 12 abut together are provided with external openings 30, such that the moving driving devices 200 may be slid together with the door 100 through the external openings 30 to thereby be exposed to the outside. Both sides of the lower panel 12 may be depressed in order to form the external openings 30.

The driving device 200 may be coupled to one side of the door 100 so as to be slid together with the door 100. The driving device 200 may slide the door 100 while moving to the outside of the air conditioner 1 through the external opening 30. When the door 100 is slid to move toward the lower panel 12, the installation member for installing the blade 7 and the blade 7 may be exposed. Conditioned air may be injected into the interior through the outlet 5 while the blade 7 is rotated.

The door 100 may include side ribs 102 formed on both sides thereof, wherein the side ribs 102 protrude so as to contact the pair of side panels 14. The pair of side panels 14 may include side guides 104 concavely formed along the movement trajectory, respectively, so that the door 100 may be stably moved. The side ribs 102 of the door 100 may include protrusions protruding toward the side panels 14 so as to be fitted into the side guides 104 of the side panels 14, respectively. The door 100 is slid in the state in which the protrusion is fitted into the side guide 104, thereby making it possible to prevent the door 100 from being separated by external force.

In order to prevent a phenomenon that a central portion of the door 100 sags due to a weight of the door itself when the door 100 of which both sides are connected to the driving devices 200 is slid, an inner side of the door 100 may be provided with at least one sag preventing part 107. The sag preventing part 107 may have a 'T' shaped cross section and be lengthily extended at an inner side of the door 100 in a direction in which the door 100 is slid. A guide 105 may be installed at a lower portion of the outlet so that the sag preventing part 107 may be caught and the door 100 slid. The guide 105 may be installed integrally with the installation member for installing the blade 7 or be installed separately from the installation member. The guide 105 may be provided with at least one protrusion corresponding to the sag preventing part 107 so that the sag preventing part 107 may be caught.

Figure 4:
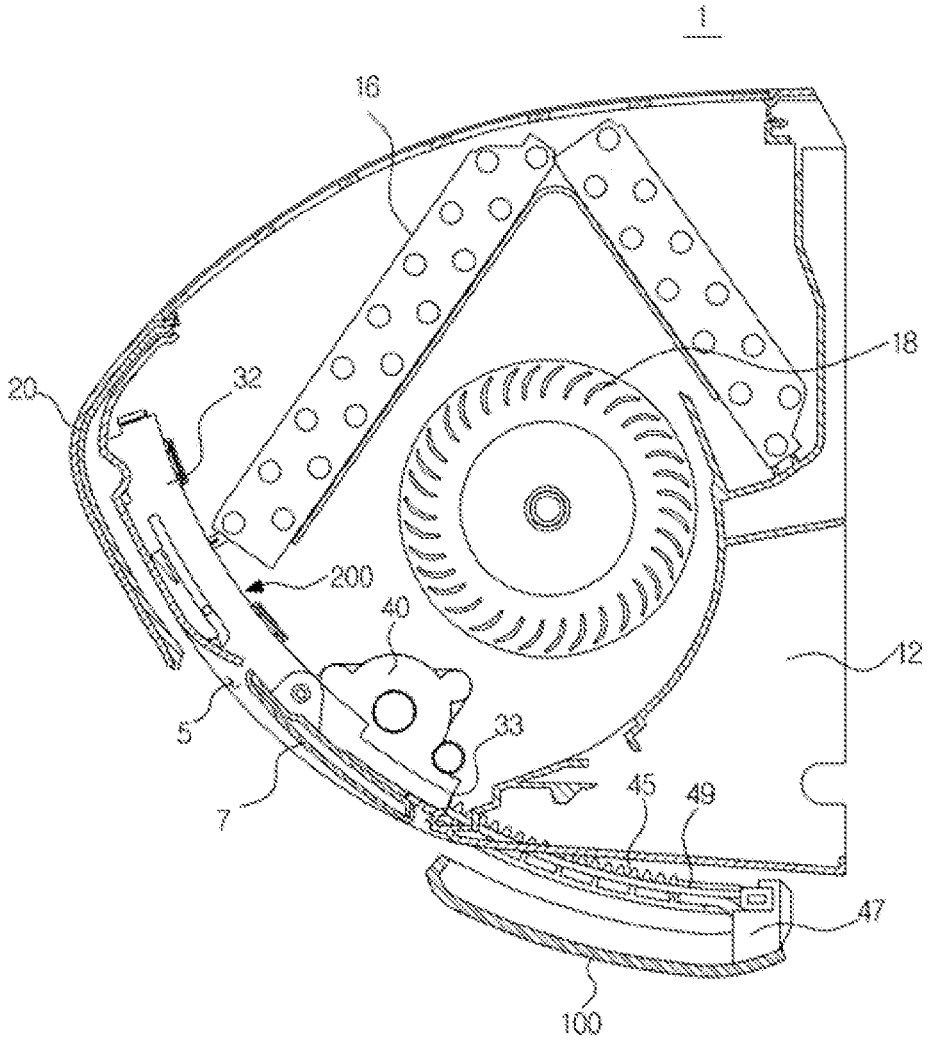
FIG. 4 is a diagram showing a side of the air conditioner according to an exemplary embodiment.

FIG. 4 is a diagram showing a side of the air conditioner 1 according to an exemplary embodiment.

An inner portion of the air conditioner 1 is provided with a heat exchanger 16 performing heat exchange with air introduced from the interior to cool or heat the air. The heat exchanger 16 serves as an evaporator at the time of a cooling operation and serves as a condenser at the time of a heating operation. A plurality of heat exchangers 16 are disposed in the air conditioner 1 so as to effectively perform heat exchange with the air introduced from the interior.

A cross-flow fan 18 may be positioned together with the heat exchanger 16 in the air conditioner. The cross-flow fan 18 may forcibly circulate the air of the interior so that the introduced air is discharged to the interior through the outlet 5. The cross-flow fan 18 may have a plurality of wings disposed in a radial direction and be coupled to a driving motor to thereby be rotated at a high speed.

The inner portion of the air conditioner 1 may be provided with a filter removing dust included in the air sucked from the interior to clean the air and a drain tray draining condensation water generated on a surface of the heat exchanger at the time of the cooling operation to the outside.

When the air conditioner 1 is operated, the cross-flow fan 18 is rotated at a high speed by the driving motor, such that the air of the interior is introduced into the air conditioner through the inlet 3 and is then heat-exchanged while passing through the heat exchanger 16. The air is again discharged to the indoor space through the outlet 5. The air conditioner 1 circulates the air by the above-mentioned process to cool or heat the indoor space.

The driving device 200 moving the door 100 opening and closing the outlet 5 may include a pinion 40 that rotates and a rack 45 engaged and moved with the pinion 40. The driving device 200 may include a case 32 forming an appearance so as to protect the pinion 40 and the rack 45 positioned therein. The case 32 may be fixed to both sides of the inner surface of the front panel 10.

The rack 45 may have a form in which a sawtooth is attached to a bar formed in a length direction and bent as a curve. Therefore, the rack 45 may be moved along a curved path depending on rotation of the pinion 40.

The case 32 may include an internal opening 33 formed at one side thereof so that the rack 45 positioned in the fixed case 32 may be exposed to the outside while moving. One side of the rack 45 exposed through the internal opening 33 may be connected to one side of the door 100. That is, one side of the rack 45 and one side of the door 100 may be coupled to each other while having a lower portion of the front panel 10 disposed therebetween.

As the air conditioner 1 is operated, the pinion 40 may be rotated and the rack 45 engaged with the pinion 40 may be moved. The rack 45 may pass through the internal opening 33 to thereby exit from the case 32, and pass through the external opening 30 provided in the body to thereby be exposed to the outside. The door 100 having one side connected to the rack 45 may be moved to a lower portion of the lower panel 12 while being slid together with the rack 45 as the rack 45 is moved.

One side of the rack 45 and one side of the door 100 are coupled to each other, such that a space in which the lower portion of the front panel 10 may be positioned may be formed between the rack 45 and the door 100. Therefore, the lower portion of the front panel 10 may be formed in a flat plate in which an opening or a coupling member for installing the rack 45 is not present. In addition, one side of the rack 45 and one side of the door 100 are connected to each other, such that the door 100 and the rack 45 may have different curvatures.

Both sides of an inner surface of the door 100 may be provided with protrusions 47 protruding inwardly. The protrusion 47 may include a rib 49 extended toward the internal opening 33 of the case 32. The rack 45 and the rib 49 may be coupled to each other in a length direction of the rack 45, and one side of the rack 45 may be coupled to the protrusion 47 while being fitted into the protrusion 47. A screw may be inserted so as to penetrate through the protrusion 47 and one side of the rack 45 that are coupled to each other, thereby fixing the protrusion 47 and one side of the rack 45. In order to stably couple the rack 45 and the door 100 to each other, the rack 45 coupled to the door 100 may include a protrusion protruding downwardly so as to be fitted into the door 100.

Since one side of the door 100 and one side of the rack 45 are coupled to each other, in the case in which the door 100 is completely separated from the front panel 10 to thereby be opened, a phenomenon that the other side of the door 100 that is not coupled to the rack 45 sags due to a weight of the door itself may occur. Therefore, the rib 49 deeply inserted into the rack 45 is provided to firmly couple the rack 45 and the door 100 to each other and move the center of gravity of the door 100 toward the center of the door 100, thereby making it possible to prevent the phenomenon that the door 100 sags.

The door 100 may be installed to be slid adjacently to the lower panel 12 in order for the entire volume of the air conditioner 1 to seem to be slim even in the state in which the door 100 is completely opened. To this end, a curvature of the door 100 may be larger than that of the rack 45. The door 100 may have the same curvature as that of the front panel 10 and be attached to the front surface of the front panel 10. As the rack 45 is moved, the door 100 is slid while gradually moving according to the curvature of the rack 45. That is, the door 100 may be slid along a movement trajectory changed from the curvature of the front panel 10 to the curvature of the rack 45.

Figure 5:
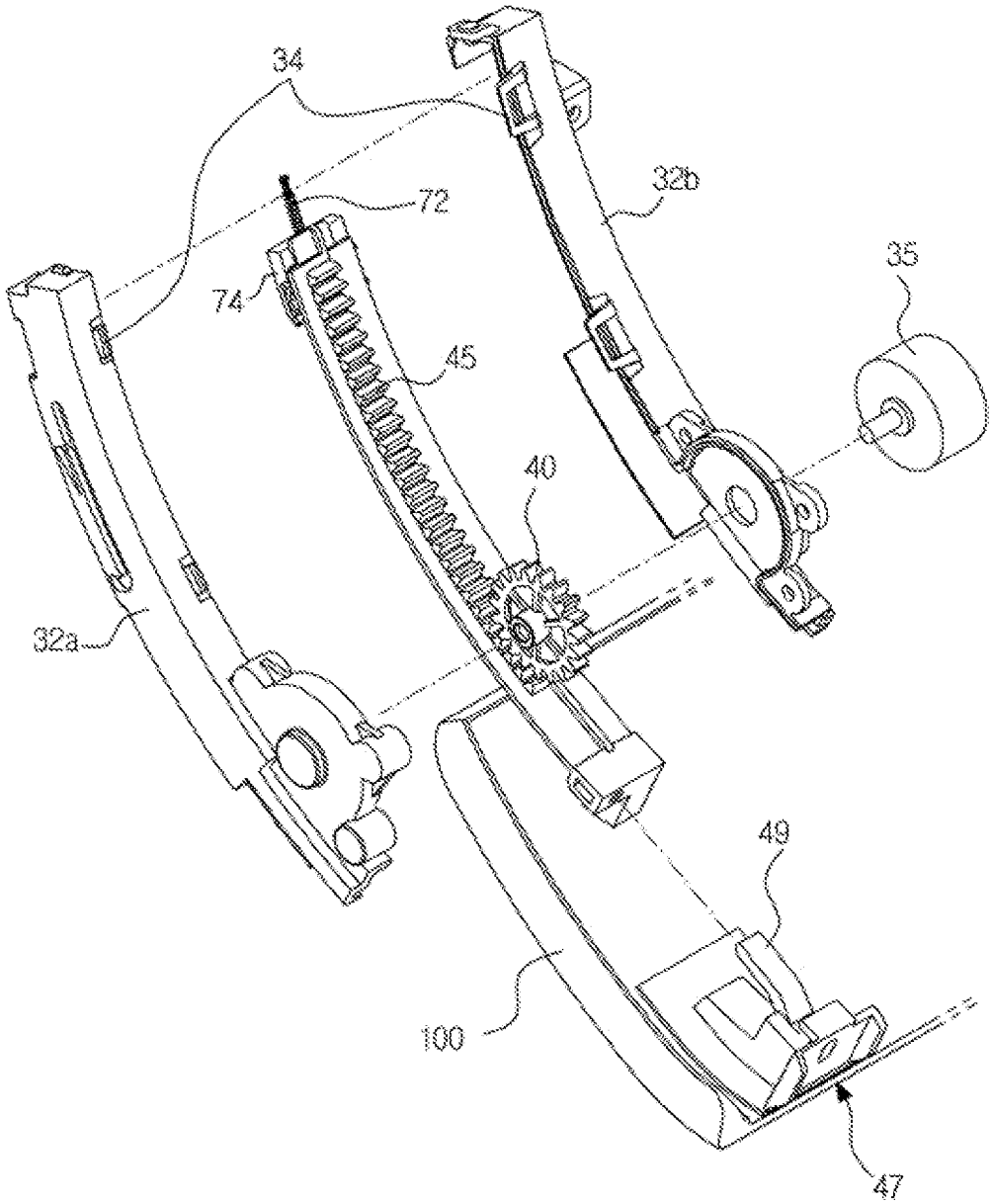
FIGS. 5 and 6 are diagrams showing a driving device of the air conditioner according to an exemplary embodiment.

FIG. 5 is a diagram showing the driving device 200 of the air conditioner 1 according to an exemplary embodiment.

The driving device 200 may include a motor 35 providing power, the pinion 40 having a shaft connected to the motor 35 to thereby be rotated, the rack 45 engaged and moved with the pinion 40, and the case 32 enclosing the motor 35, the pinion 40, and the rack 45. As described above, the rack 45 has one side coupled to the door 100, such that it may be slid together with the door 100.

The case 32 may include first and second cases **32*a* and 32*b* and have an internal space formed therein so that the rack 45, the pinion 40, and the motor 35 may be positioned therein. The case 32 may have a form in which it is bent in the length direction in accordance with a form of the rack 45 and have a circular space formed at one side thereof so as to receive the motor 35 and the pinion 40. The first and second cases 32*a* and 32*b* may be coupled to each other using a hook 34 and be fixed to a rear surface of the front panel 10**.

In the case in which the door 100 is opened, the door 100 descends depending on a weight of the door itself. Therefore, a torque required in the case in which the door 100 is opened is less than a torque required in the case in which the door ascends against the weight of the door itself to thereby be closed. In the last 20 to 30% section in which the door 100 is closed, a torque larger than a maximum torque required to open the door 100 is required.

When the driving device 200 is provided in accordance with the torque required in the last 20 to 30% section, a gear having a large reduction gear ratio needs to be used or a specification of the motor 35 needs to be high. In the case in which the reduction gear ratio is large, a driving speed is decreased, and in the case in which the motor having the high specification is used, efficiency is decreased in terms of a size and a cost. Therefore, it is efficient to satisfy the torque required in the last 20 to 30% section by finding a method of securing a torque margin.

As one method of securing the torque margin, there is a method of variably controlling the motor 35. The motor 35 may be a step motor rotated by a predetermined angle depending on input pulses. The step motor may be controlled by a pulse per second (PPS). In the last 20 to 30% section, the PSS is slightly slowly controlled, thereby making it possible to control a torque. For example, in the last 20 to 30% section, when a pulse speed is doubly increased to doubly slow the PPS, an additional torque may be obtained.

Figure 6:
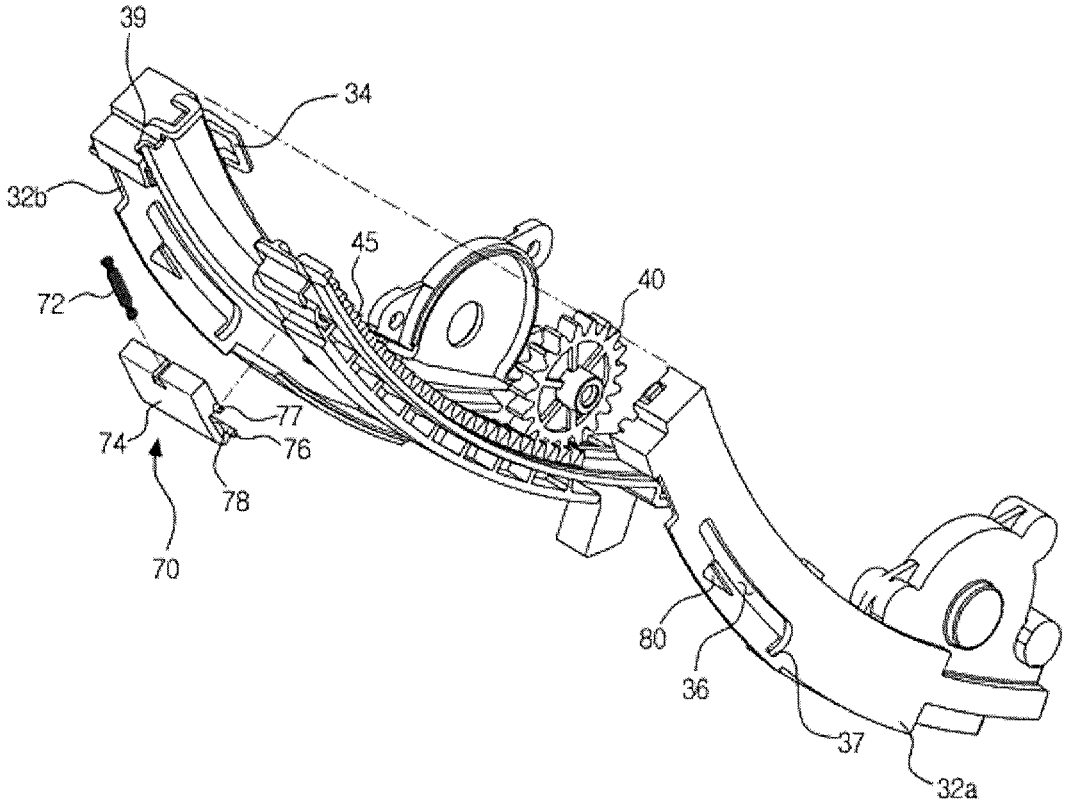

FIG. 6 is a diagram showing the driving device 200 of the air conditioner 1 according to an exemplary embodiment.

As another method of securing the torque margin, there is a method of installing an auxiliary device 70 providing elastic force. The auxiliary device 70 may be positioned together with the rack 45 and the pinion 40 in the case 32. The auxiliary device 70 may include a spring 72 providing the elastic force and a connection member 74 having one side connected to the spring 72 to thereby be moved.

The auxiliary device 70 may be installed in the vicinity of the last 20 to 30% of an ascending section so as to provide the elastic force to the rack 45. The spring 72 may be fixed to a connector 39 positioned at one side of the case 32, and the connection member 74 may be connected to a side of the spring 72 opposite to one side of the spring 72 fixed to the connector 39. A side of the connection member 74 opposite to the side of the connection member 74 connected to the spring 72 may be coupled to the rack 45 so that the connection member 74 may be moved while expanding and contracting the spring 72 as the rack 45 is moved.

Four sides of the connection member 74 may have a similar plate shape, and one side thereof may be similar length to that of the rack 45. The connection member 74 may have a concave surface 78 formed at a central portion thereof so that the rack 45 may be coupled thereto, and a lower portion of the rack 45 may be convexly formed so as to correspond to the concave surface 78, One side of the rack 45 may be put on the connection member 74, and the lower portion of the rack 45 may be coupled to the concave surface 78. A section in which the rack 45 and the connection member 74 are coupled to each other and are moved is called an interworking section.

Both sides of the concave surface 78 may be provided with a plurality of protrusions 76 and 77 protruding outwardly. The protrusions 76 and 77 are formed so as to correspond to both sides of the connection member 74, such that a total of four protrusions, that is, a pair of upper protrusions 77 and a pair of lower protrusions 76 may be formed. The pair of upper protrusions 77 and the pair of lower protrusions 76 may be fitted into auxiliary guides 36 formed along a movement path of the connection member 74 at both sides of the case 34.

In the case in which the door 100 is opened while the rack 45 is moved to the outside, the connection member 74 may also be moved downwardly along the rack 45 fixed to the concave surface 78. The upper and lower protrusions 77 and 76 are moved while being slid along the auxiliary guides 36, and the spring 72 connected to the connection member 74 is expanded. One side of the auxiliary guide 36 may be provided with a bent fixing groove 37 so that the connection member 74 is separated from the rack 45 and is fixed in the state in which the spring 72 is expanded.

The connection member 74 is inclined while the lower protrusion 76 of the connection member 74 moved along the rack 45 is fitted into the bent fixing groove 37. The rack 45 may be separated from the concave surface 78 of the inclined connection member 74 and move the door 100 while being continuously moved downwardly. The connection member 74 may be fixed in the state in which the lower protrusion 76 is fitted into the fixing groove 37, and the spring 72 may be fixed in the state in which it is expanded by a movement distance of the connection member 74.

In the case in which the door 100 is closed, the rack 45 may ascend while being again moved inwardly of the case 32 and be again coupled to the connection member 74 fixed to the vicinity of a start point of the interworking section. The connection member 74 that has been inclined may again return to the state in which it is not inclined while being coupled to the rack 45, and the lower protrusion 76 may exit from the fixing groove 37. The spring 72 starts to compress the connection member 74 with elastic force with which it is to return to its original state, thereby making it possible to provide force to the rack 45 through the connection member 74 connected thereto to allow the rack 45 to ascend. Therefore, in the interworking section, force of the motor 35 and the elastic force of the spring 72 are summed, such that the rack 45 ascends to the end. As a result, the door 100 may be again attached to the front surface of the front panel 10.

Figure 7:
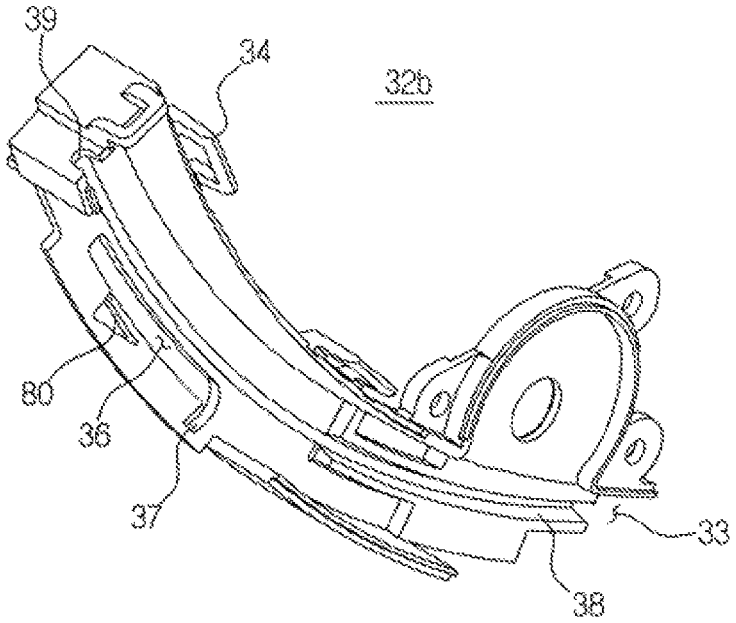
FIG. 7 is a diagram showing a case of the driving device of the air conditioner according to an exemplary embodiment.

FIG. 7 is a diagram showing a diagram showing the case 32 of the driving device 200 of the air conditioner 1 according to an exemplary embodiment.

For convenience, the second case 32*b* of the driving device 200 has been shown in FIG. 7, and the first and second cases 32*a* and 32*b* have the same configuration as each other. The second case 32*b* may be coupled to the first case 32*a* using the hook 34 to form a space in which the auxiliary device 70, the rack 45, the pinion 40, and the like, may be positioned. One side of the second case 32*b* may be provided with the internal opening 33 so that the rack 45 may be moved outwardly, and the other side thereof may be provided with the connector 39 to which the spring 72 may be fixed. The auxiliary guide 36 and the fixing groove 37 may be disposed in the interworking section in which the connection member 74 of the second case 32*b* is moved together with the rack 45.

The auxiliary guide 36 may be provided with a safety groove 80 into which the protrusions 76 and 77 may be inserted, in addition to the fixing groove 37. In the case in which the rack 45 is moved downwardly to open the door 100, the lower protrusion 76 of the connection member 74 is fitted into and fixed to the fixing groove 37. In this case, the lower protrusion 76 deviates from the fixing groove 37 due to external impact, such that the connection member 74 may be moved upwardly by the elastic force of the spring 72. In this situation, when the rack 45 is moved upwardly, it is difficult for the rack 45 to be coupled to the concave surface 78 of the connection member 74 that is not inclined. Therefore, the safety groove 80 is provided, such that the lower protrusion 76 is inserted into the safety groove 80 and then returns to the fixing groove 37, thereby making it possible to couple the rack 45 to the concave surface 78.

An inner surface of the case 32*b* may be provided with a guide 38 concavely formed along a movement path of the rack 45 so that the rack 45 may be stably moved. The guide 38 may be extended from one side of the case 32*b* to the other side of the case 32*b* along the movement path of the rack 45. However, in this case, contact friction between the rack 45 and the guide 38 may be increased. As the contact friction is increased, a larger torque may be required to move the rack 45. Therefore, in order to decrease the contact friction, the guide 38 may be formed in a minimum section in which the rack 45 may be stably moved along the movement path.

Figure 8A:
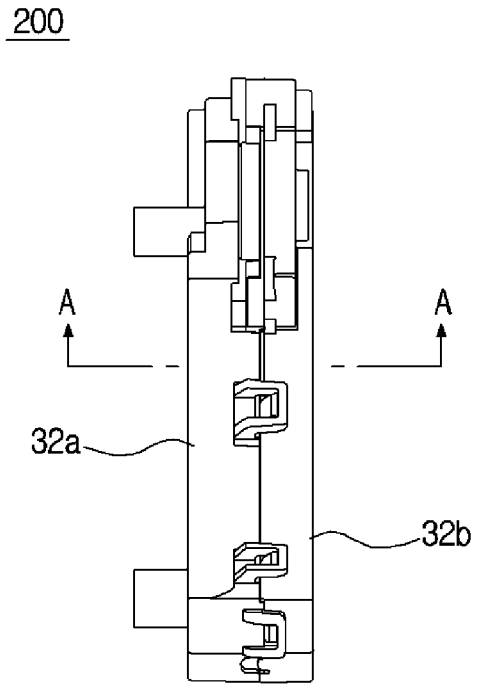
FIG. 8A is a diagram showing a driving device and FIG. 8B is a diagram showing a cross section of the driving device of the air conditioner according to an exemplary embodiment.
Figure 8B:
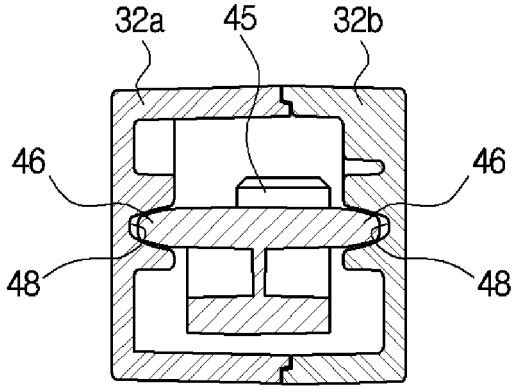

FIG. 8A is a diagram showing a driving device and FIG. 8B is a diagram showing a cross section of the driving device 200 of the air conditioner 1 according to an exemplary embodiment.

Even though the guide 38 is formed in the minimum section, since a surface on which the rack 45 and the guide 38 contact each other is large, the contact friction may be still present. The rack 45 may have an upper surface on which a sawtooth engaged with the pinion 40 is formed and both sides on which rack ribs 46 movable along the guide 38 are formed. The rack rib 46 may be fitted into a contact surface 48 positioned on an inner surface of the guide 38 and be slid.

The contact surface 48 may have a form in which it encloses upper and lower portions of the rack rib 46 so that the rack rib 46 does not deviate from the guide 38. Due to the contact surface 48 contacting the rack rib 46 in the form in which it encloses the upper and lower portions of the rack rib 46, the contact friction may be increased. Therefore, in order to decrease the contact friction between the rack rib 46 and the contact surface 48, the rack rib 46 may be inserted into the contact surface 48 while having a gap. The rack rib 46 has a gradient larger than that of the contact surface 48, such that the rack rib 46 and the contact surface 48 do not surface-contact each other, but may line-contact each other. An empty space is formed between the rack rib 46 and the contact surface 48 contacting each other, such that the contact friction may be decreased.

According to exemplary embodiments, a clean and smooth appearance may be formed using a door slid along a curved path and a slim appearance may be formed even in the state in which the door is opened.

In addition, in a section in which additional power is required while the door ascends, a time required for driving the door may be decreased using a spring.

Although specific shapes have been mainly described, they may be variously modified and altered by those skilled in the art. These modifications and alterations should be interpreted to fall within the scope of embodiments.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. An air conditioner comprising:

a front panel including a first panel part having an inlet and a second panel part connected to a lower portion of the first panel part and having an outlet;

a lower panel connected to the second panel part of the front panel of the air conditioner and extended toward a rear portion of the air conditioner; and a door installed on a front surface of the second panel part of the front panel to open and close the outlet, wherein the door is slid along a curved movement trajectory from an exterior surface of the front panel toward the lower panel and overlapping with an exterior surface of the lower panel, and wherein the door includes a rack spaced apart from and fixed in a position, relative to the door, substantially parallel to a rear surface of the door, facing away from the door, and engaged with and moved by a pinion to thereby move the door, and wherein the rack is connected to the door at a first end of the rack so that an interior space between the rack and the door extends continuously from the first end of the rack to a second end of the rack, opposite the first end of the rack, and to an exterior space of the door and the rack, and wherein the door is able to be slid together with the rack, when the outlet is closed, a lower portion of the second panel part is accommodated in the interior space between the door and the rack, and when the outlet is opened, at least a part of the lower portion of the second panel part exits from the interior space between the door and the rack.

2. The air conditioner according to claim 1, further comprising a driving device positioned at one side of an inner portion of the front panel and providing power so that the door is slidable.

3. The air conditioner according to claim 2, wherein the driving device includes a motor providing the power, and the pinion includes a shaft connected to the motor to thereby be rotated.

4. The air conditioner according to claim 3, wherein the motor is a step motor rotated by a predetermined angle depending on input pulses.

5. The air conditioner according to claim 4, wherein the motor is operated so as to be variably controlled when additional power is required while the door reciprocates.

6. The air conditioner according to claim 3, wherein the front panel is disposed between the rack and the rear surface of the door so that the door is movable as the rack moves toward the lower panel.

7. The air conditioner according to claim 6, wherein:

the rack is extended in a length direction while having a curvature, and the door and the rack have different curvatures.

8. The air conditioner according to claim 7, wherein a curvature of the door is larger than the curvature of the rack so that the door is slid adjacently to the lower panel.

9. The air conditioner according to claim 1, wherein:

at least a portion of the front panel is formed as a curved surface so that the front panel protrudes to be convex with respect to a fan of the air conditioner.

10. The air conditioner according to claim 9, wherein:

one side of the front panel is configured to contact a wall, and one side of the front panel is configured to be spaced apart from the wall so that the lower panel is positioned.

11. The air conditioner according to claim 10, further comprising a cover covering at least a portion of the front panel, wherein the door is connected to the cover to cover at least a portion of the front panel, and wherein the cover and the door have the same thickness so as to form a smooth surface.

12. The air conditioner according to claim 1, further comprising a pair of side panels installed on both sides of the front panel and the lower panel, wherein the door includes side ribs on both sides thereof, the side ribs protruding so as to contact the pair of side panels.

13. The air conditioner according to claim 12, wherein:

the pair of side panels include side guides concavely formed on outer surfaces thereof along the curved movement trajectory, respectively, so that the door is stably movable, and the side ribs include protrusions protruding toward the pair of side panels so as to be fitted into the side guides, respectively.

14. The air conditioner according to claim 1, wherein a blade is installed in the outlet of the front panel for changing a direction of discharged air.

15. An air conditioner comprising:

a front panel formed on the air conditioner so as to be convex with respect to a fan of the air conditioner and having an outlet disposed at a lower portion thereof;

a lower panel connected to the front panel of the air conditioner and extended toward a rear portion of the air conditioner;

a door installed on a front surface of the front panel to open and close the outlet, the door including a rack; and a driving device including a pinion rotatably installed in the front panel, wherein one side of the rack and one side of the door are connected to each other so that at least a portion of the front panel is positioned between the rack and the door, wherein the door overlaps with an exterior surface of the lower panel at an open position of the door, wherein the rack is spaced apart from and fixed in a position, relative to the door, substantially parallel to a rear surface of the door, facing away from the door, and engaged with and moved by the pinion to thereby move the door, wherein the rack is connected to the door at a first end of the rack so that an interior space between the rack and the door extends continuously from the first end of the rack to a second end of the rack, opposite the first end of the rack, and to an exterior space of the door and the rack, and wherein the door is able to be slid together with the rack, when the outlet is closed, a part of the lower portion of the front panel is accommodated in the interior space between the door and the rack, and when the outlet is opened, a part of the lower portion of the front panel exits from the interior space between the door and the rack.

16. The air conditioner according to claim 15, wherein the driving device includes a case fixed in the front panel so as to form an appearance to protect the pinion and the rack positioned therein.

17. The air conditioner according to claim 16, wherein:

the case includes an opening formed at one side thereof so that the rack is movable outwardly, and one side of the rack exposed through the opening is connected to one side of the door.

18. The air conditioner according to claim 16, wherein an inner portion of the case has a guide concavely along a movement path of the rack so that the rack is stably movable.

19. The air conditioner according to claim 18, wherein the rack includes a sawtooth engaged with the pinion and rack ribs on both sides of the sawtooth, the rack ribs being inserted into the guide while having a gap in order to decrease contact friction with the guide.

20. The air conditioner according to claim 18, wherein the guide is formed in a partial section of the movement path of the rack in order to decrease contact friction between the rack and the guide.

21. The air conditioner according to claim 15, wherein:

an inner surface of one side of the door has a protrusion, and one side of the rack is coupled to the protrusion while being fitted into the protrusion so that the door is moved as the rack is moved.

22. The air conditioner according to claim 21, wherein:

the protrusion includes a rib extended inward an opening, and the rack and the rib are coupled to each other in a length direction of the rack.

23. An air conditioner comprising:

a body;

an outlet formed at a lower portion of the body of the air conditioner and discharging air;

a door installed on a front exterior surface of the body so as to open and close the outlet;

a driving device providing power to slide the door in front of the front exterior surface of the body; and an auxiliary device installed so as to elastically bias the door upwardly, wherein the door overlaps with at least a portion of an exterior surface of the body at an open position of the door, wherein the door includes a rack spaced apart from and fixed in a position, relative to the door, substantially parallel to a rear surface of the door, facing away from the door, and engaged with and moved by a pinion to thereby move the door, and wherein the rack is connected to the door at a first end of the rack so that an interior space between the rack and the door extends continuously from the first end of the rack to a second end of the rack, opposite the first end of the rack, and to an exterior space of the door and the rack, and wherein the door is able to be slid together with the rack, when the outlet is closed, a part of the lower portion of the body is accommodated in the interior space between the door and the rack, and when the outlet is opened, a part of the lower portion of the body exits from the interior space between the door and the rack.

24. The air conditioner according to claim 23, wherein:

the driving device includes the rotating pinion, and the auxiliary device includes a spring providing elastic force and a connection member connected to one side of the spring to thereby be moved.

25. The air conditioner according to claim 24, wherein:

the driving device includes a case having the auxiliary device positioned therein, the case includes an opening formed at one side so that the rack is movable outwardly, and one side of the rack exposed through the opening is connected to one side of the door.

26. The air conditioner according to claim 25, wherein:

one side of the spring is fixed to one side of the case, and a side of the connection member opposite to the side of the connection member connected to the spring is coupled to the rack so that the connection member is movable as the rack is moved.

27. The air conditioner according to claim 26, wherein:

the connection member includes protrusions formed at both sides thereof, and both sides of the case are provided with auxiliary guides formed as an opening along an interworking section in which the connection member and the rack are coupled to each other and are moved, so that the protrusions are fitted into the auxiliary guides and moved therealong.

28. The air conditioner according to claim 27, wherein one side of the auxiliary guide has a bent fixing groove into which the protrusion is inserted, so that the connection member is separated from the rack and is fixed in the state in which the spring is expanded, in the case in which the rack is moved outwardly through the opening.

29. The air conditioner according to claim 28, wherein the auxiliary guide includes a safety groove having the protrusion inserted thereinto by the rack and then returning the protrusion to the fixing groove so that the rack enters the case through the opening to thereby be coupled to the connection member, in the case in which the protrusion deviates from the fixing groove due to external impact, such that the connection member is moved by the elastic force.

* * * * *